US008740732B2

(12) United States Patent
Finelli

(10) Patent No.: US 8,740,732 B2
(45) Date of Patent: Jun. 3, 2014

(54) DISCUS TRAINING DEVICE

(76) Inventor: Dominic Finelli, Revere, MA (US)

( * ) Notice: Subject to any disclaimer, the term of this patent is extended or adjusted under 35 U.S.C. 154(b) by 298 days.

(21) Appl. No.: 13/278,529

(22) Filed: Oct. 21, 2011

(65) Prior Publication Data

US 2012/0100941 A1 Apr. 26, 2012

Related U.S. Application Data

(60) Provisional application No. 61/405,371, filed on Oct. 21, 2010.

(51) Int. Cl.

| | |
|---|---|
| ***A63B 49/00*** | (2006.01) |
| ***A63B 47/02*** | (2006.01) |
| ***A63B 71/14*** | (2006.01) |
| ***A41D 19/00*** | (2006.01) |

(52) U.S. Cl.
USPC ..... 473/518; 2/160

(58) Field of Classification Search
USPC ..... 473/518; 2/160
See application file for complete search history.

(56) References Cited

U.S. PATENT DOCUMENTS

| | | | | |
|---|---|---|---|---|
| 2,522,344 | A * | 9/1950 | Carmin | 2/160 |
| 2,751,598 | A * | 6/1956 | Romeo | 2/161.3 |
| 4,511,148 | A * | 4/1985 | Amos et al. | 473/465 |
| 4,700,405 | A * | 10/1987 | Sternberg | 2/161.1 |
| 4,730,354 | A * | 3/1988 | Saito | 2/161.2 |
| 5,004,231 | A * | 4/1991 | Alread | 482/139 |
| 5,386,591 | A * | 2/1995 | Canan | 2/160 |
| 5,414,868 | A * | 5/1995 | Crawford | 2/160 |
| 5,468,200 | A * | 11/1995 | Hoffman | 482/55 |
| 5,518,480 | A | 5/1996 | Frappier | |
| 5,522,780 | A | 6/1996 | Roddy | |
| 7,070,540 | B1 | 7/2006 | Priester | |
| 8,281,416 | B1 * | 10/2012 | Smith | 2/161.6 |
| 2004/0018899 | A1 * | 1/2004 | Thiruppathi | 473/464 |
| 2010/0037363 | A1 * | 2/2010 | Oakman | 2/161.2 |
| 2011/0296578 | A1 * | 12/2011 | Lee | 2/48 |
| 2012/0100941 | A1 * | 4/2012 | Finelli | 473/518 |

OTHER PUBLICATIONS

Webpage download, NationalThrows , 2004, www.nationalthrowscoachesassociation.com/Basic_Technique_for_Discus_Throwing.htm, 9 pages.*

Webpage download, DiscusDrills , 2008, http://nleb.schoolwires.net/cms/lib4/PA01000149/Centricity/Domain/72/Discus_Drills.doc, 9 pages.*

(Continued)

*Primary Examiner* — Gene Kim
*Assistant Examiner* — M Chambers
(74) *Attorney, Agent, or Firm* — Porter, Wright, Morris & Arthur, LLP

(57) ABSTRACT

A training device for use with a regulation discus includes a glove body sized and shaped for receiving at least a portion of a hand of a discus thrower therein and an attachment for securing the regulation discus to the glove body at a front of the glove body such that the discus thrower can grasp the regulation discus and practice throwing the discus without releasing the regulation discus from the glove body. The glove body has a wrist opening, at least one thumb opening, and at least one finger opening. Thus, even if the discus thrower inadvertently lets go of the regulation discus, the regulation discus is not thrown because it is secured to the glove body worn by the discus thrower. The attachment can be straps that are secured about the regulation discus.

18 Claims, 9 Drawing Sheets

(56) References Cited

OTHER PUBLICATIONS

Webpage download, TheBritishMuseum, 2001, /www.britishmuseum.org/explore/highlights/highlight_objects/aoa/p/pair_of_sealskin_mittens_aa-1.aspx, 1 page.*

Webpage download, Trackand fieldnews, 2005, www.trackandfieldnews.com/technique/110-Tommy_Bardon.pdf, 5 pages.*

* cited by examiner

DISCUS TRAINING DEVICE

CROSS-REFERENCE TO RELATED APPLICATIONS

This application claims the priority benefit of U.S. provisional Patent Application No. 61/405,371 filed on Oct. 21, 2010, the disclosure of which is expressly disclosed herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to athletic training device and, more particularly, to training devices for the discus throwing.

BACKGROUND OF THE INVENTION

The discus throw is an event in track and field athletic competitions, in which an athlete throws a heavy disc, typically called a discus, in an attempt to mark a farther distance than his or her competitors. The discus throw is an ancient sport which can be dated back at least to 708 BC. Today, the discus throw is a part of most modern track and field meets at all levels of competition and is a sport which is particularly noted as part of the Olympic Games. In ancient Greece, discus throwing was considered the paramount event of the Olympic games.

The discus 10, the object to be thrown, is a heavy lenticular-shaped disc that is convex shaped. The discus typically has a weight of 2 kilograms (about 4 pounds and 7 ounces) and a diameter of 220 millimeter (about 8.66 inches) for the men's events, and a weight of 1 kilogram (about 2 pounds and 3 ounces) and diameter of 181 millimeter (about 7.17 inches) for the women's events. In U.S. high school track and field events, boys often throw a discus weighing 1.616 kilograms (about 3 pounds and 9 ounces) and the girls throw the 1 kilogram (about 2.2 pounds) women's discus. The discus usually has sides made of rubber, plastic, wood, or metal with a metal rim and a metal core to attain the weight. A discus with more weight in the rim produces greater angular momentum for any given spin rate, and thus more stability, although it is more difficult to throw. A discus made of solid rubber is often used in high school either in competition or practice because it is less expensive to purchase, more durable, and easier to learn to throw (due to its more equal distribution of weight, as opposed to the heavy rim weight of the metal rim/core discus).

To make a throw, the competitor starts in a slightly recessed concrete-surfaced circle having a diameter of 2.5 meters (about 8 feet and 2½ inches). The discus thrower typically takes an initial stance facing away from the direction of the throw. The discus thrower then spins counter-clockwise (for right-handers) around one and a half times through the circle to build momentum, then releases the discus. The discus must land within a 34.92-degree arc extending from the circle and marked by lines on the landing zone. The distance from the front edge of the circle to where the discus lands is measured. The competitor's best throw from the allocated number of throws, typically three to six, is recorded, and the competitor who legally throws the discus the farthest is declared the winner.

The basic motion is a forehanded sidearm movement. The discus is spun off the index finger or the middle finger of the throwing hand. In flight, the discus spins clockwise when viewed from above for a right-handed thrower, and counter-clockwise for a left-handed thrower. As well as achieving maximum momentum in the discus upon throwing, the discus' distance is also determined by the trajectory imparted by the thrower, as well as the aerodynamic behavior of the discus. Generally, throws into a moderate headwind achieve the maximum distance. Also, a faster-spinning discus imparts greater gyroscopic stability.

The technique of discus throwing is quite difficult to master and needs lots of experience to perfect. As a result, discus throwers must spend much time practicing their throws and, in particular, their throwing motion. Discus throwers often practice their throwing motion over and over without releasing the discus. However, this can be problematic if done in doors, without adequate space, or near other people because it can at times be difficult to maintain a hold on the discus when practicing the throwing motion at full speed and power. As a result various weights or specialty discs are used which include fasteners to secure the specialty discs and or weights to the thrower. These devices, however, can alter the feel and motion of the discus thrower because they are not training with a regulation discus that they must throw at competitions. Accordingly, there is a need for an improved discus training device.

SUMMARY OF THE INVENTION

Disclosed are discus training devices which overcome at least one of the above-described problems of the related art. Disclosed is a training device for use with a regulation discus that comprises, in combination, a glove body sized and shaped for receiving at least a portion of a hand of a discus thrower therein and an attachment for securing the regulation discus to the glove body at a front of the glove body such that the discus thrower can grasp the regulation discus and practice throwing the discus without releasing the regulation discus from the glove body. The glove body has a wrist opening, at least one thumb opening, and at least one finger opening Also disclosed is a training device in combination with a regulation discus. The training device comprises a glove body sized and shaped for receiving at least a portion of a hand of a discus thrower therein and an attachment securing the regulation discus to the glove body at a front of the glove body such that the discus thrower can grasp the regulation discus and practice throwing the discus without releasing the regulation discus from the glove body. The glove body has a wrist opening, at least one thumb opening, and at least one finger opening;

Also disclosed is method of training to throw a discus. The method comprises, in combination, obtaining a regulation discus. placing a glove body on at least a portion of a hand of a discus thrower, and securing the regulation discus to the glove body at a front of the glove body with an attachment such that the discus thrower can grasp the regulation discus and practice throwing the discus without releasing the regulation discus from the glove body. The glove body has a wrist opening, at least one thumb opening, and at least one finger opening.

From the foregoing disclosure and the following more detailed description of various preferred embodiments it will be apparent to those skilled in the art that the present invention provides a significant advance in the technology and art of discus training devices. Particularly significant in this regard is the potential the invention affords for providing relatively low cost, versatile, effective, and easy to use training device. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
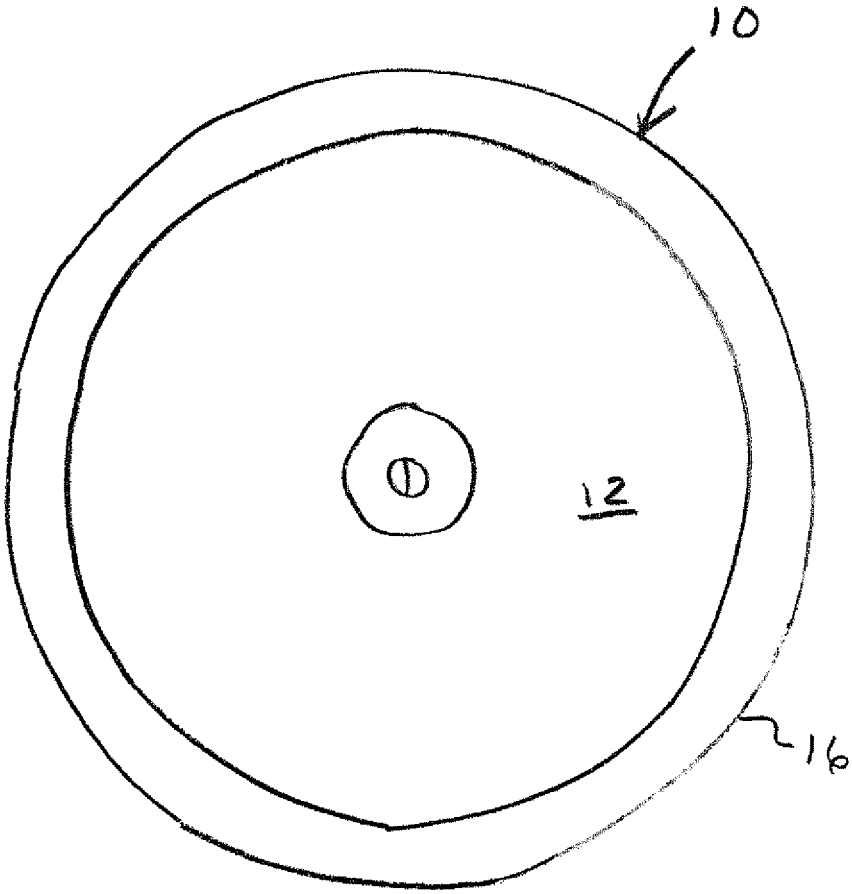
FIG. 1 is a top view of a regulation discus which can be used with the training device according to the present invention.

It should be understood that the appended drawings are not necessarily to scale, presenting a somewhat simplified representation of various preferred features illustrative of the basic principles of the invention. The specific design features of the training devices as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the training devices illustrated in the drawings. In general, front or forward generally refers to a direction out of the plane of the paper in FIGS. 4, 7, 10, 13, 15, and 18 and back or rearward generally refers to a direction out of the plane of the paper in FIGS. 3, 6, 9, 12, 14 and 17.

DETAILED DESCRIPTION OF CERTAIN PREFERRED EMBODIMENTS

It will be apparent to those skilled in the art, that is, to those who have knowledge or experience in this area of technology, that many uses and design variations are possible for the discus training disclosed herein. The following detailed discussion of various alternative and preferred embodiments will illustrate the general principles of the invention. Other embodiments of the present invention suitable for other applications will be apparent to those skilled in the art given the benefit of this disclosure.

Figure 2:
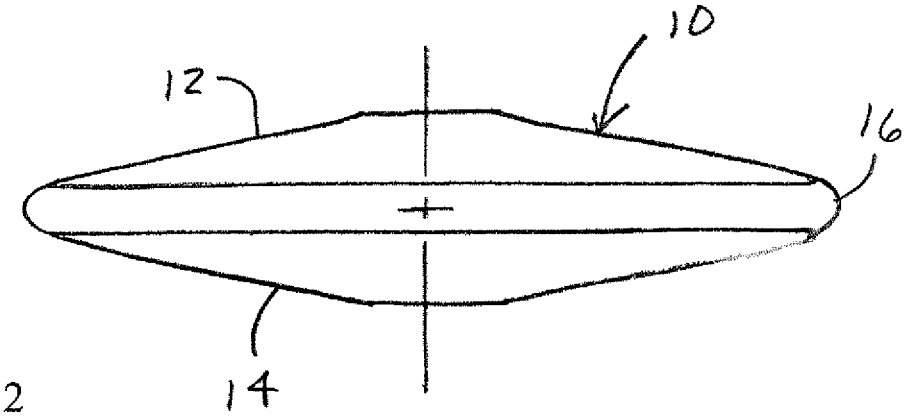
FIG. 2 is a side elevational view of the discus of FIG. 1.

Referring now to the drawings, FIGS. 1 and 2 illustrates a regulation discus 10 which is a heavy lenticular-shaped disc. The regulation discus 10 has upper and lower convex-shaped sides 12, 14 connected by a peripheral rim 16. See U.S. Pat. No. 5,522,780 for an example of a regulation discus conforming with the rules and specifications of track and field governing bodies such as, for example, the Athletics Congress of the USA and the International Amateur Athletic Federation, the disclosure of which is expressly incorporated herein in its entirety. The term "regulation discus" is used in this specification and claims to mean a discus conforming with the rules and specifications of a track and field governing body such as, for example, the Athletics Congress of the USA, the International Amateur Athletic Federation, the Amateur Athletic Union, the National Collegiate Athletic Association, and high school athletic associations, and not having any specialty fasteners or the like thereon for training purposes or for interlocking or otherwise securing the discus to a training device or the like. Thus, a regulation discuss is an unaltered, off-the-shelf, commercially available discus that can be used in a sanctioned track and field competition.

Figure 4:
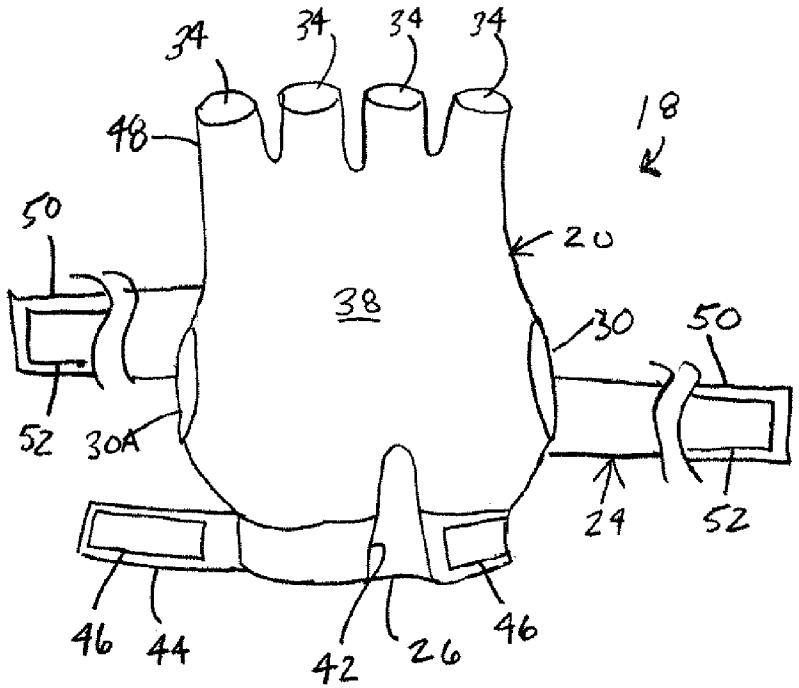
FIG. 4 is a front view of the training device of FIG. 3.
Figure 3:
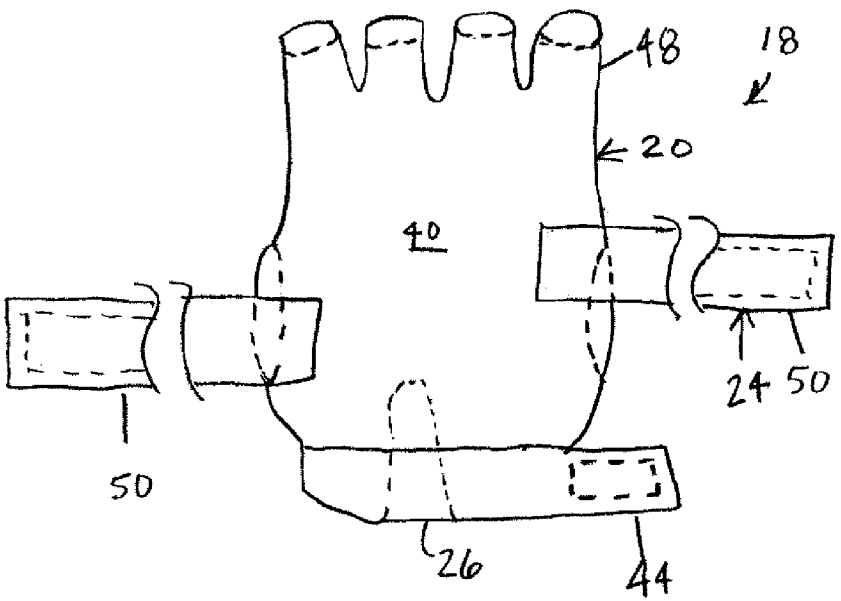
FIG. 3 is a rear view of a training device according to the present invention.
Figure 5:
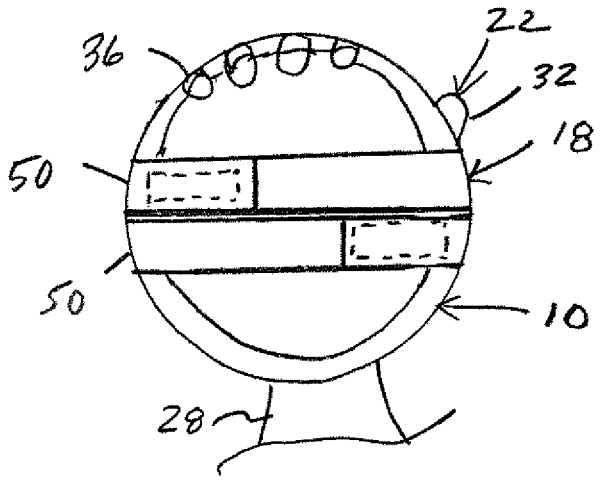
FIG. 5 is a front view of the training device of FIGS. 3 and 4 on the right hand of a discus thrower with the regulation discus of FIGS. 1 and 2 secured thereto.

Referring now to the drawings, FIGS. 3 to 5 illustrate a discus training device 18 according to a first embodiment of the present invention. The illustrated training device 18 is designed for use with a regulation discus 10 and comprises a glove body 20 sized and shaped for receiving at least a portion of a hand 22 of a discus thrower therein and an attachment 24 for securing the regulation discus 10 to the glove body 20 at a front side of the glove body 20 such that the discus thrower can grasp the regulation discus 10 and practice throwing the regulation discus 10 without releasing the regulation discus 10 from the glove body 20 to prevent inadvertent throws of the regulation discus 10. The illustrated glove body 20 has a wrist opening 26 for passage of the thrower's wrist or arm 28 therethrough, at least one thumb opening 30 for passage of the thrower's thumb 32 therethrough, and at least one finger opening 34 for passage of the thrower's four fingers 36 therethrough. Thus, the practice throws can simulate actual competition throws without the danger of inadvertent throws.

The illustrated glove body 20 includes front portion 38 and a rear portion 40 of material connected along opposed lateral sides to form an inner hollow space or cavity sized and shaped for receiving at least a portion of the thrower's hand 22. The front and rear portions 38, 40 can be secured together in any suitable manner such as sewing or the like. It is noted that the glove body 20 can be alternatively formed by a single portion or more than two portions of material if desired. The glove body 20 can be formed of any suitable material such as, for example, an elastic fabric, inelastic fabric, a combination of elastic and inelastic fabrics, and the like.

The illustrated glove body 20 forms the main or wrist opening 26 at its lower end for insertion of the discus thrower's hand 22 therein. The glove body 20 is preferably close fitting to the thrower's hand 22 so that it does not impact or has minimal impact on the way the thrower holds and throws the regulation discus 10. To ease placing the glove body 20 on the thrower's hand 22 and taking the glove body 20 off of the thrower's hand 22, the illustrated front portion 38 is provided with a split or notch 42 at its lower edge. Additionally, the glove body 20 includes a wrist strap 44 that can be tightly and releasably secured around the thrower's wrist 28 or the bottom of their hand 22. The wrist strap 44 enables the glove body 20 to be tightly secured to the throwing hand 22 and wrist 28 so that the glove body 20 does not inadvertently slip off of the discus thrower's hand 22 during training. The illustrated wrist strap 44 is provided with hook and loop fastener 46, such as Velcro, but any other suitable releasable fastening means can alternatively be utilized such as buckles, snaps, buttons, hooks, ties, and the like.

The illustrated glove body 20 is in the form of a four-finger glove having four separate finger openings 34 for the discus thrower's four fingers 36 to extend out of the glove body 20 and a thumb opening 30 for the discus thrower's thumb 32 to extend out of the glove body 20. It is preferred for the thrower's fingers and thumb 36, 32 to extend out of the glove body 20 so that they directly contact and grasp the regulation discus 10 when training. The illustrated glove body 20 also has another or second thumb opening 30A on the opposite side of the glove body 20 so that the glove body 20 can be used on either a left or right hand 22 of the thrower. The illustrated glove body 20 is sized and shaped so that the glove body 20 can be used on a either a right or a left hand. It is noted that the glove body 20 can alternatively be provided with only a single thumb opening 30 if the glove body 20 is designed for only one of either right or left handed use. It is also noted that the glove body 20 can have other quantities of finger openings 34 such as, for example, one, two or three openings where one or more fingers 36 share a common finger opening 34.

The illustrated finger openings 34 are each formed at the ends of finger stalls 48. The illustrated finger stalls 48 extend only to and not beyond the end of the proximal phalanx of the fingers 36 but any other suitable length can alternatively be utilized. It is noted that the finger stalls 48 can be eliminated if desired and/or the thumb opening 30 can be provided with thumb stalls if desired.

The illustrated attachment 24 includes a pair of straps 50 sized and shaped such that they can be wrapped about the glove body 20 and the regulation discus 10 and secured in place to secure the regulation discus 10 to the glove body 20 and thus the hand 22 of the discus thrower. It is noted that just one or more than two of the straps 50 can alternatively be utilized. The straps 50 can be formed of any suitable material such as, for example, an elastic fabric, inelastic fabric, Nylon, and the like. The illustrated straps 50 are provided with hook and loop fasteners 52 so that they can be releasably secured in place but any other suitable releasable securing means can alternatively be utilized such as, for example, buckles, snaps, buttons, hooks, ties, and the like. The illustrated straps 50 are attached to opposite sides of the glove body 20 and are slightly offset in the longitudinal or vertical direction of the glove body 20 so that they are located one above the other.

As best shown in FIG. 5, once the glove body 20 is secured on the thrower's hand 22 and the thrower grasps the regulation disc 10 on the palm or front side of their hand 22, the straps 50 are wrapped around the glove body 20 and the regulation disc 10 and secured in place with the hook and loop fastener 52 to secure the regulation discus 10 to the glove body 20 and thus the throwers' hand 22. The illustrated straps 50 are secured in a parallel and offset manner. It is noted that the attachment 24 can alternatively be of any other suitable type that does not alter the regulation discus 10. With the regulation discus 10 secured in this manner, the discus thrower can practice their throwing motion with the regulation discus 10 at full speed and power without fear of accidentally releasing the regulation discus 10. When training is complete, the regulation discus 10 can be unsecured by un-securing and unwrapping the straps 50 and the glove body 20 can be removed by un-securing the wrist strap 44 and pulling the glove body 20 off of the throwers hand 22. The regulation disk 10 can then still be used separate from the glove body 20 in practice and/or competition in a normal manner.

Figure 8:
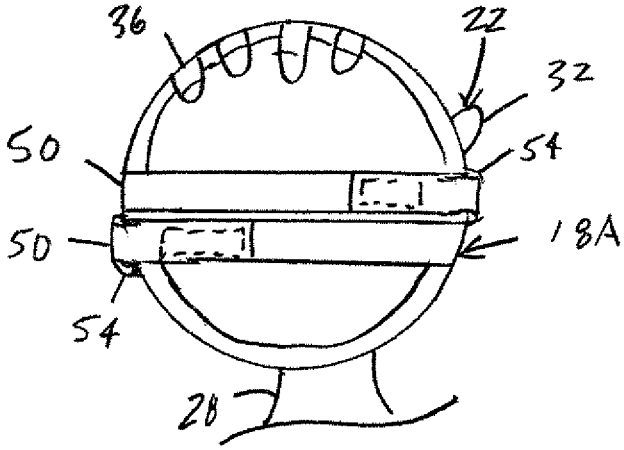
FIG. 8 is a front view of the training device of FIGS. 6 and 7 on the right hand of a discus thrower with the regulation discus of FIGS. 1 and 2 secured thereto.
Figure 7:
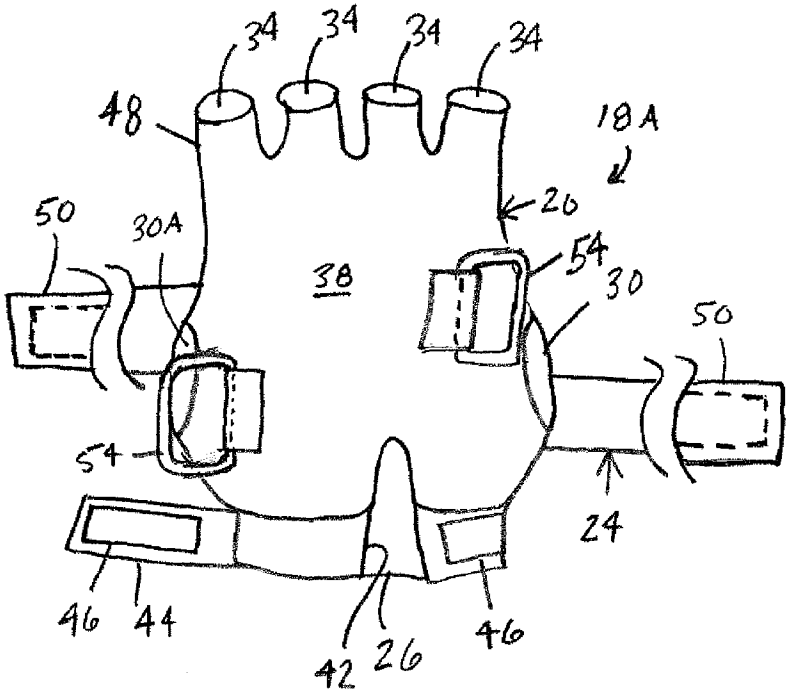
FIG. 7 is a front view of the training device of FIG. 6.
Figure 6:
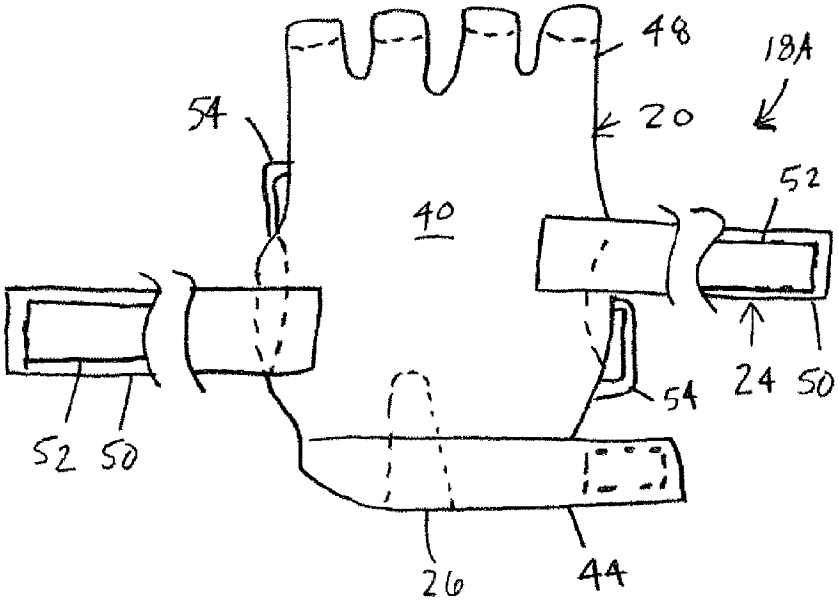
FIG. 6 is a rear view of a training device according to a second embodiment of the present invention.

FIGS. 6 to 8 illustrate a discus training device 18A according to a second embodiment of the present invention. This discus training device 18A is substantially the same as the discus training device 18 according to the first embodiment described herein above except that buckle loops 54 are provided to aid in securing the straps 50. The illustrated loops 50 are rigid and secured to the glove body 20 opposite the attachment point of the cooperating strap 50 so that the straps 50 can extend over the regulation disc 10, through the loops 54 and back over themselves, and then secured to themselves with the hook and loop fastener 52. The loops 54 enable the straps 50 to be pulled tighter. The loops 54 can comprise any suitable material and can be secured to the glove body 20 in any suitable manner.

Figure 11:
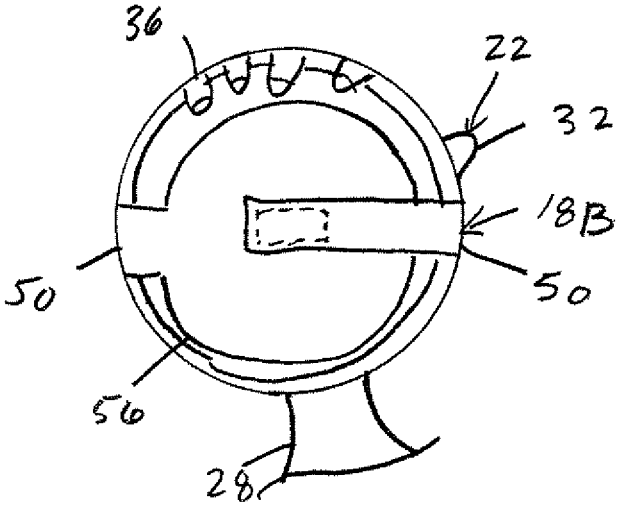
FIG. 11 is a front view of the training device of FIGS. 9 and 10 on the right hand of a discus thrower with the regulation discus of FIGS. 1 and 2 secured thereto.
Figure 10:
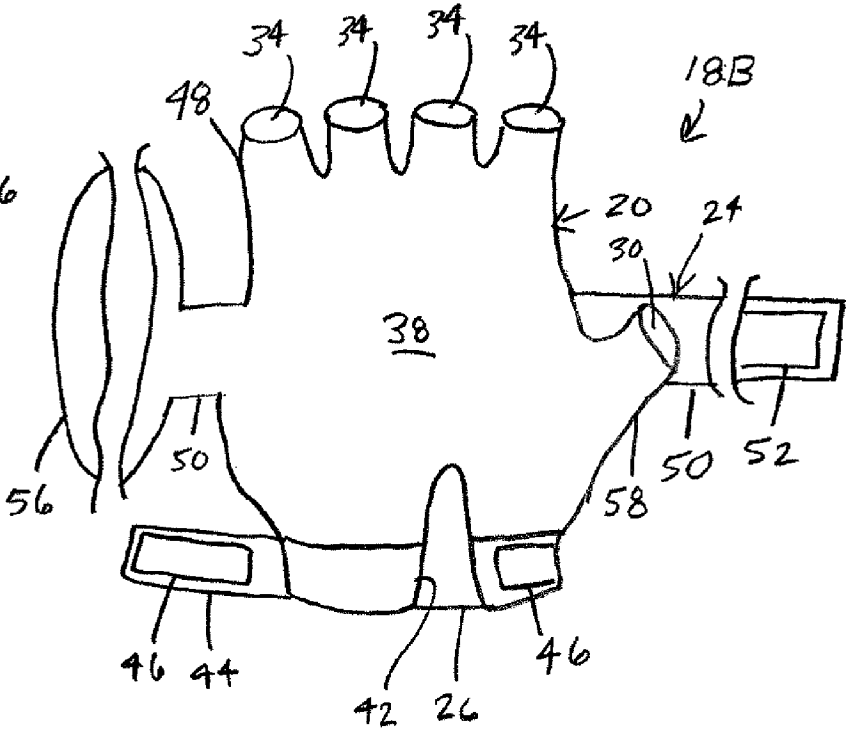
FIG. 10 is a front view of the training device of FIG. 9.
Figure 9:
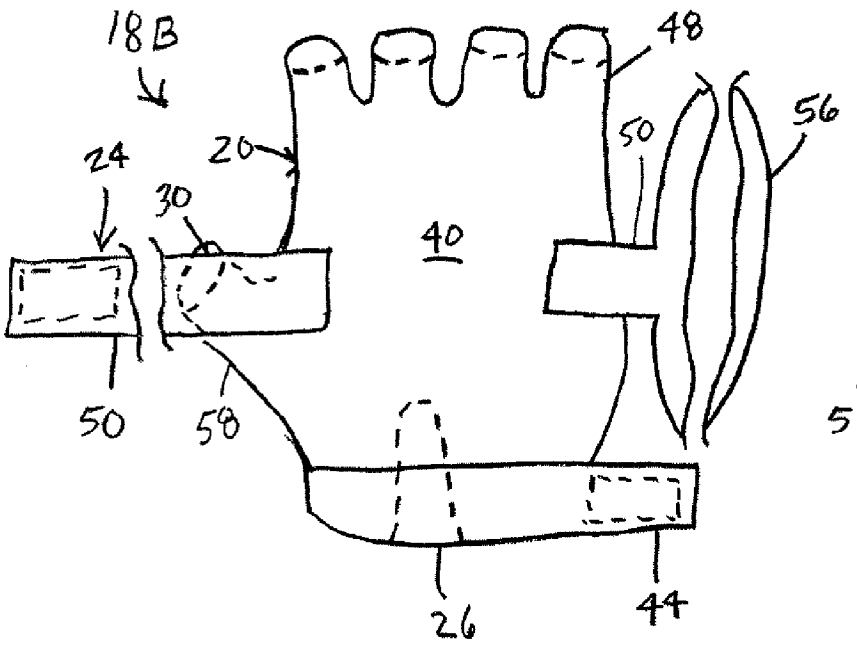
FIG. 9 is a rear view of a training device according to a third embodiment of the present invention.

FIGS. 9 to 11 illustrate discus training devices 18B according to a third embodiment of the present invention. This discus training device 18B is substantially the same as the discus training device 18 described according to the first embodiment herein above except that there is a single thumb opening 30 and one of the straps 50 is provided with a cover 56. The illustrated glove body 20 has a single thumb opening 30 positioned so that it is designed for use on only the discus thrower's right hand 22. Additionally, the thumb opening 30 is provided at a thumb stall 58. The illustrated thumb stall 58 extends only to and not beyond the end of the proximal phalanx of the thumb 32 but any other suitable length can alternatively be utilized. It is noted that the thumb stall 58 can be eliminated if desired as shown and discussed above. The illustrated right-side strap 50 is provided with the cover 56 which is sized and shaped to substantially cover the regulation discus 10 while the left-side strap 50 is provided with hook and loop fastener 52 and is sized and shaped to extend over the cover 56 to secure the cover 56 in place. The illustrated cover 56 is circular to cooperate with the regulation disk 10 and has a diameter slightly smaller than the regulation disc 10 so that the cover 56 does not interfere with the thrower's fingers 36 directly grasping the regulation disc 10. The cover 56 can alternatively have any other suitable size and shape. The cover 56 can comprise any suitable material but preferably at least a portion of the cover 56 is more rigid than the straps 50 to further assist in securing the regulation disc 10 to the glove body 20. For example, the cover 56 can have a rigid portion with an inner side shaped generally concave to cooperate with the convex shape of the regulation disc 10. Also for example, the cover 56 can have a rigid portion supporting an inner portion of deformable material, such as foam and the like, that contacts and deforms to the shape of the regulation disc 10 so that the cover 56 cooperates with the convex shape of the regulation disc 10. When the cover 56 cooperates with the convex shape of the regulation disc 10, an interference is created between the cover 12 and the regulation disc 10 that further prevents the regulation disk 10 from inadvertently sliding out from under the straps 50.

Figure 13:
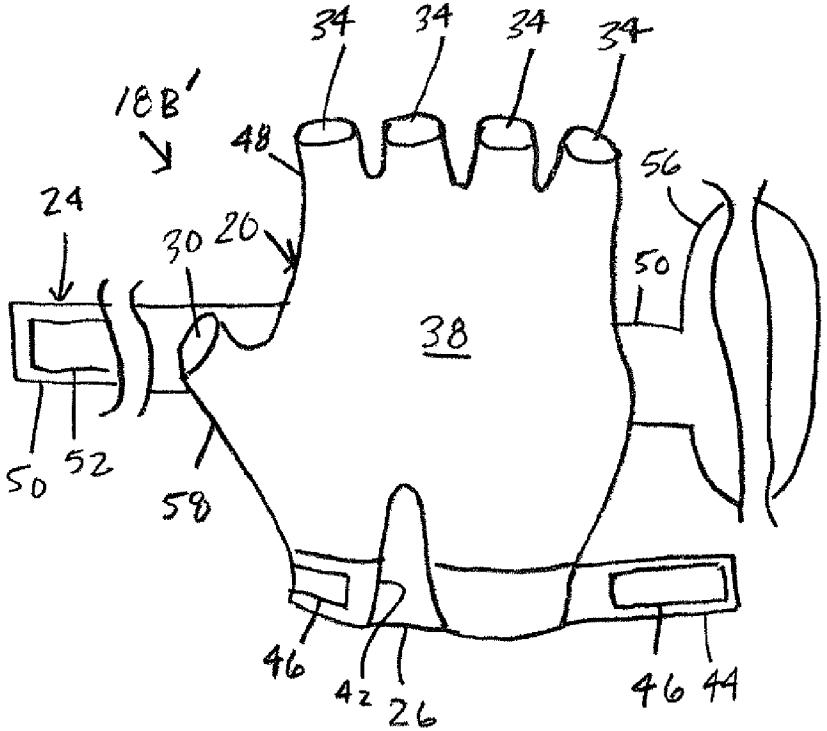
FIG. 13 is a front view of the training device of FIG. 12.
Figure 12:
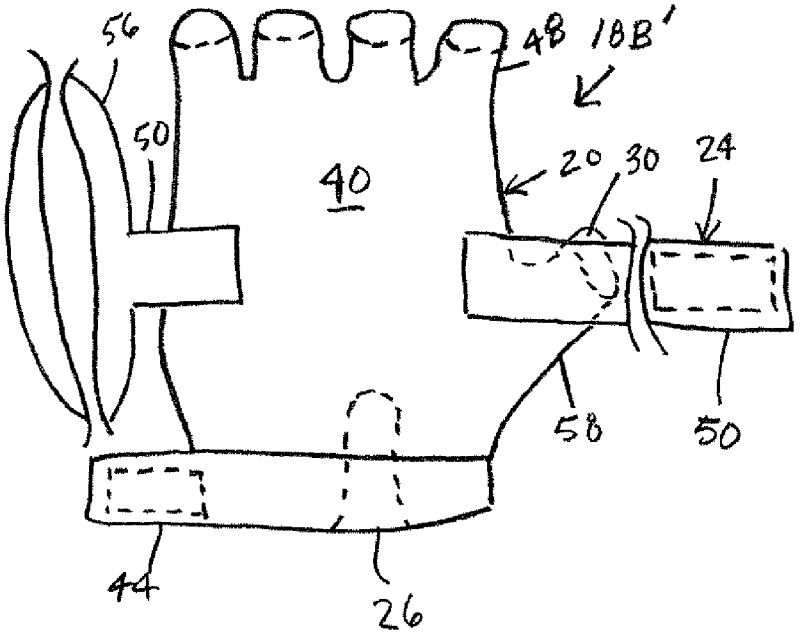
FIG. 12 is a rear view of a training device according to a variation of the third embodiment of the present invention shown in FIGS. 9 to 11, wherein it is adapted for use on a left hand rather than a right hand.

FIGS. 12 and 13 illustrate of variation of the training device 18B' according to the third embodiment of the present invention. This discus training device 18B' is substantially the same as the discus training device 18B of embodiment three described herein above except that the single thumb opening 30 is positioned on the opposite side of the glove body 20 so that the glove body 20 is designed for use on only one of the discus thrower's left hand 22.

Figure 15:
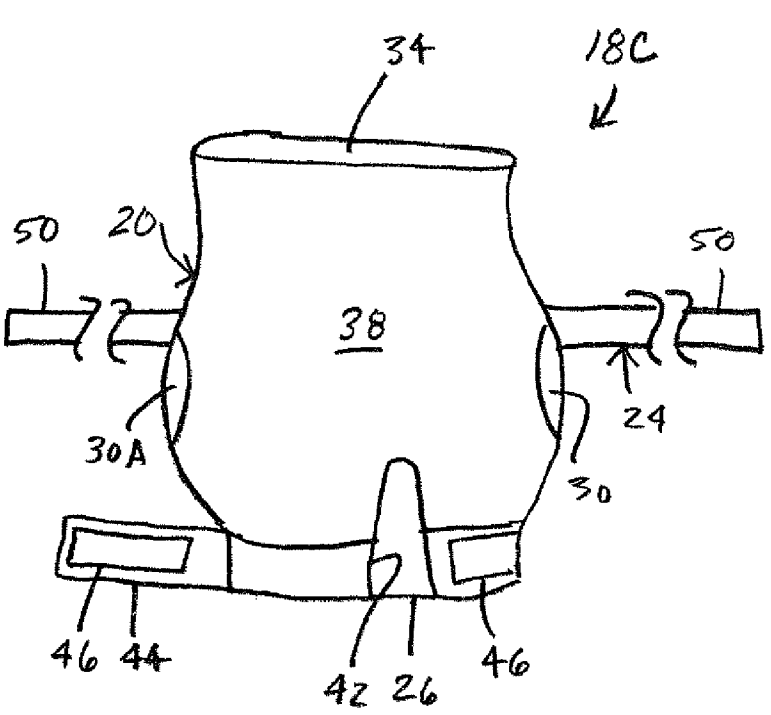
FIG. 15 is a front view of the training device of FIG. 14.
Figure 14:
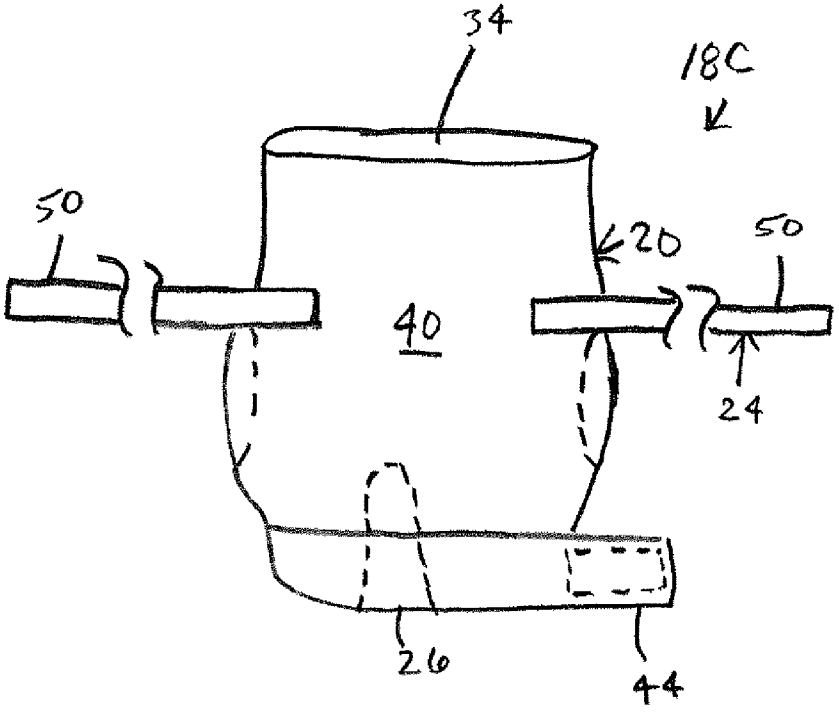
FIG. 14 is a rear view of a training device according to a fourth embodiment of the present invention.
Figure 16:
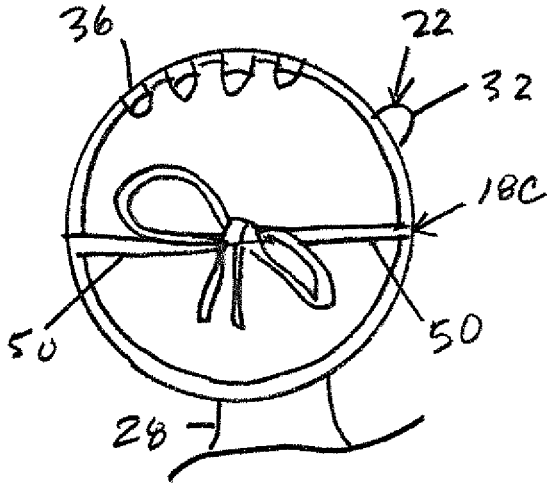
FIG. 16 is a front view of the training device of FIGS. 14 and 15 on the right hand of a discus thrower with the regulation discus of FIGS. 1 and 2 secured thereto.

FIGS. 14 to 16 illustrate a discus training device 18C according to a fourth embodiment of the present invention. This discus training device 18C is substantially the same as the discus training 18 device according to the first embodiment described herein above except that a single finger opening 34 is provided for all of the discus thrower's four fingers and the attachment 24 is in the form of two straps 50 that are sized and shaped to be tied about the regulation discus 10. The illustrated single finger opening 34 is sized so that all four of the thrower's fingers 36 extend out of the glove body 20 through a common opening 34. The illustrated attachment 24 includes a pair of the straps 50 secured to the glove body 20 on opposite sides of the glove body 20 at substantially the same height. The straps 50 are sized and shaped and comprise a suitable material such that they can be tied together to secure the regulation disc 10 to the glove body 20. The illustrated straps 50 have a length such that the straps 50 extend over and are tied in front of the regulation disc 10. The straps 50 can be provided with longer lengths so that the straps 50 extend entirely around the regulation disc 10 and the glove body 20 one or more times before being tied together. It is noted that any other suitable quantity and/or orientation of the straps 50 can be utilized. It is also noted that the two straps 50 can alternatively provided with hook and loop fasteners or other releasable fastening means rather than being tied if desired.

Figure 19:
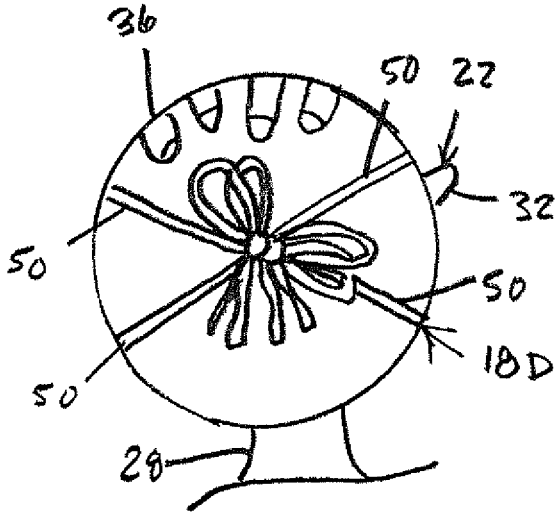
FIG. 19 is a front view of the training device of FIGS. 17 and 18 on the right hand of a discus thrower with the regulation discus of FIGS. 1 and 2 secured thereto.
Figure 18:
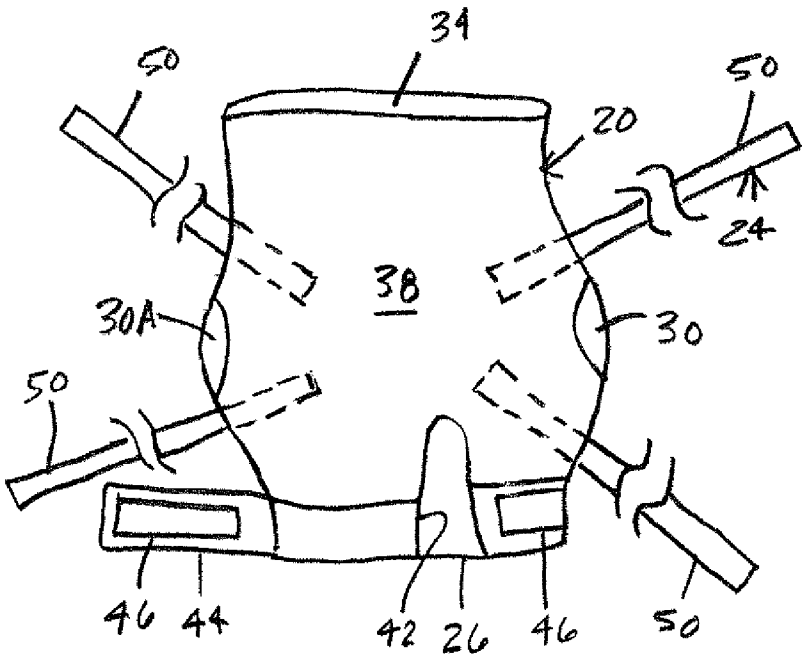
FIG. 18 is a front view of the training device of FIG. 17.
Figure 17:
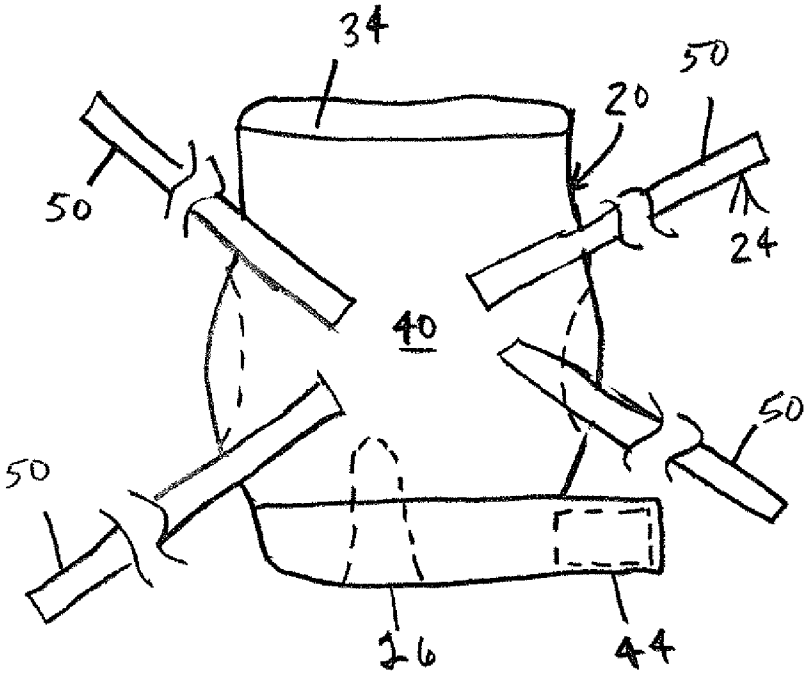
FIG. 17 is a rear view of a training device according to a fifth embodiment of the present invention.

FIGS. 17 to 19 illustrate a discus training device 18D according to a fifth embodiment of the present invention. This discus training device 18D is substantially the same as the discus training device 18C according to the fourth embodiment described herein above except that the attachment 24 comprises four straps 50 which are sized and shaped to be tied about the regulation discus 10 in a crisscross manner to secure the regulation disc 10 to the glove body 20. Pairs of the straps 50 are secured to the glove body 20 on opposed sides of the glove body 20 and the straps 50 are angled to form an x-like pattern. Positioned in this manner, the straps 50 provide more resistance to movement of the regulation disc 10 relative to the glove body 20 in the vertical or longitudinal direction of the glove body 20, that is, wrist-to-finger direction. The straps 50 are sized and shaped and comprise a suitable material such that they can be tied together to secure the regulation disc 10 to the glove body 20. The illustrated straps 50 have a length such that they extend over and are tied in front of the regulation disc 10. The straps 50 can be provided with longer lengths so that the straps 50 extend entirely around the regulation disc 10 and the glove body 20 one or more times before being tied together. It is noted that any other suitable quantity and/or orientation of the straps can be utilized. It is also noted that the four straps 50 can alternatively provided with hook and loop fasteners or other releasable fastening means rather than being tied if desired Any of the features or attributes of the above the above described embodiments and variations can be used in combination with any of the other features and attributes of the above described embodiments and variations as desired.

From the foregoing disclosure it is appreciated that the illustrated training devices 18, 18A, 18B, 18C, 18C', 18D enable a thrower to train in a true simulation without actually throwing the regulation disc 10 while avoiding inadvertent throws. Importantly, an unaltered regulation disc 10 is utilized so that the thrower experiences the same experience as when actually throwing in competitions. Also, utilizing the regulation disc 10 minimizes the amount of training equipment that must be separately purchased From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A training device in combination with a regulation discus comprising, in combination.

a regulation discus sized and shaped for throwing throwing during a track and field competition; and a training device comprising:

a glove body sized and shaped for receiving at least a portion of a hand of a discus thrower therein and having a wrist opening, at least one thumb opening, and at least one finger opening; and an attachment releasably securing the regulation discus to the glove body at a front of the glove body such that the discus thrower can grasp the regulation discus in an unaltered manner and practice a throwing motion with the regulation discus without releasing the regulation discus during training so that the discus thrower experiences the same grasp and throwing motion with the training device as when throwing the regulation discus without the training device;

wherein the attachment includes at least two straps directly secured to the glove body and sized and shaped to wrap about the regulation discus to removably secure the regulation discus to the body glove and the hand of the discus thrower and wherein at least one of the straps is provided with a cover secured thereto for securing the regulation discus that creates an interference with the regulation discus to prevent the regulation discus from inadvertently sliding out from under the straps.

2. The combination according to claim 1, wherein the glove body has two thumb openings on opposed sides and a single finger opening configured so that the glove body can be used on a right or left hand of the discus thrower.

3. The combination according to claim 1, wherein the regulation discus is an unaltered commercially available throwing discuss for use in sanctioned track and field competitions.

4. The combination according to claim 1, wherein the attachment includes hook and loop fasteners for securing the straps about the regulation discus.

5. The combination according to claim 1, wherein the attachment includes loops secured to the glove body for receiving the straps to secure the straps about the regulation discus.

6. The combination according to claim 1, wherein the cover is generally circular shaped and has a diameter smaller than the regulation discuss so that the cover does not interfere with the discus thrower's grasp of the regulation, discus.

7. The combination according to claim 1, wherein the straps are sized and shaped to be tied for securing the straps about the regulation discus.

8. The combination according to claim 1, wherein there are four of the straps with two of the straps secured to each of two opposed sides of the glove body and angled to form an x-like pattern.

9. A training device in combination with a throwing discus comprising, in combination:

a throwing discus sized and shaped for throwing during a track and field competition; and a training device comprising:

a glove body sized and shaped for receiving at least a portion of a hand of a discus thrower therein and having a wrist opening, at least one thumb opening, and at least one finger opening; and an attachment releasably securing the throwing discus to the glove body at a front of the glove body such that the discus thrower can grasp the throwing discus in an unaltered manner and practice a throwing motion with the regulation discus without releasing the throwing discus during training so that the discus thrower experiences the same grasp and throwing motion with the training device as when throwing the regulation discus without the training device;

wherein the attachment includes at least two straps directly secured to the glove body and size and shaped to wrap about the regulation discus secure the regulation discus to the body and the hand of the discus thrower and wherein at least one of the straps is provided with a cover secured thereto for securing the regulation discus that creates an interference with the regulation discus to prevent the regulation discus from inadvertently sliding out from under the straps.

10. The combination according to claim 9, wherein the glove body has two thumb openings on opposed sides and a single finger opening configured so that the glove body can be used on a right or left hand of the discus thrower.

11. The combination according to claim 9, wherein the at least two straps are directly secured to the glove body on opposed sides the glove body.

12. The combination according to claim 9, wherein the attachment includes hook and loop fasteners for securing the straps about the throwing discus.

13. The combination according to claim 9, wherein the attachment includes loops secured to the glove body for receiving the straps to secure the straps about the throwing discus.

14. The combination according to claim 9, wherein at the cover is generally circular shaped and has a diameter smaller than the throwing discuss so that the cover does not interfere with the discus thrower's grasp of the regulation discus.

15. The combination according to claim 9, wherein the straps are sized and shaped to be tied for securing the straps about the throwing discus.

16. The combination according to claim 9, wherein there are four of the straps with two of the straps secured to each of two opposed sides of the glove body and angled to form an x-like pattern.

17. A method of training to throw a discus utilizing the device of claim 1, said method comprising, in combination:

placing the glove body on at least a portion of a hand of a discus thrower; and securing the regulation discus to the glove body at a front of the glove body with the attachment such that the discus thrower can grasp the regulation discus and practice throwing the discus without releasing the regulation discus.

18. The method according to claim 17, wherein the step of securing the regulation discus to the glove body includes the step of securing straps about the regulation disk, wherein the straps are secured to the glove body.

* * * * *